US006449409B1

(12) United States Patent
Minami et al.

(10) Patent No.: US 6,449,409 B1
(45) Date of Patent: Sep. 10, 2002

(54) END-FACE LAPPING APPARATUS AND METHOD OF LAPPING

(75) Inventors: Kouji Minami; Hiroyuki Tokita, both of Tokyo; Nobuo Suzuki, deceased, late of Tokyo, by Sagako Suzuki, executor; Muneo Kawasaki, Tokyo, all of (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/035,480

(22) Filed: Mar. 5, 1998

(30) Foreign Application Priority Data

Mar. 6, 1997 (JP) ..... 9-052148

(51) Int. Cl.[7] ..... G02B 6/26
(52) U.S. Cl. ..... 385/30
(58) Field of Search ..... 385/24, 30, 31, 385/39, 53, 129, 147; 372/6

(56) References Cited

U.S. PATENT DOCUMENTS

| | | | | |
|---|---|---|---|---|
| 4,530,097 A | * | 7/1985 | Stokes et al. | 372/6 |
| 4,684,215 A | * | 8/1987 | Shaw et al. | 385/30 |
| 4,733,938 A | * | 3/1988 | Lefeve et al. | 385/30 |
| 5,184,433 A | | 2/1993 | Maack | 51/283 |
| 5,497,443 A | | 3/1996 | Jie et al. | 385/134 |

FOREIGN PATENT DOCUMENTS

| | | |
|---|---|---|
| JP | 3-26456 | 2/1991 |
| JP | 60173904 | 3/1992 |
| WO | WO9409944 | 5/1994 |

OTHER PUBLICATIONS

Patent Abstracts of Japan, vol. 012, No. 485 (M–777) Dec. 19, 1988.

Patent Abstracts of Japan, vol. 097, No. 004 Apr. 30, 1997.

* cited by examiner

*Primary Examiner*—Akm E. Ullah
(74) *Attorney, Agent, or Firm*—Adams & Wilks

(57) ABSTRACT

An end-face lapping apparatus, comprises a rod member W supported on an apparatus main body by a support mechanism through a fixing jig board. A lapping board has a lapping member for lapping the rod member and is rotatably swingably supported on the apparatus main body by a drive mechanism. The drive mechanism causes the lapping board to rotate about a first rotating center and at the same time swivel rotating center about a second rotating center to thereby carry out lapping while urging the rod member W fitted in the fixing jig board against the lapping member of the rotatably swinging lapping board by the support mechanism. The end-face lapping apparatus has a relative position shift device for shifting the relative position of the lapping board and the fixing jig board. The rod member W is lapped at a different portion of the lapping member each time the relative position shift device shifts the relative position of the lapping board.

5 Claims, 7 Drawing Sheets

END-FACE LAPPING APPARATUS AND METHOD OF LAPPING

BACKGROUND OF THE INVENTION

The present invention relates to an end-face lapping apparatus and lapping method for lapping end faces of rod members such as fibers for optical communications.

Optical fibers are used by adhesive-fixing a fiber within the center bore of a ferrule as a principal member of a connector and then lapping smoothly a ferrule end face and a fiber end face at a same time into a mirror finish. If the lapped surfaces of the ferrule and the fiber are not normal to the center axis of the ferrule or the lapped surface has a mar, the oppositely-positioning accuracy in an optical connector connecting between opposite ferrules degrade, resulting in large loss. The lapped surface of the ferrule, including the optical fiber, therefore requires a lap finish with accuracy.

There is, for example, a disclosure in Japanese Laid-open Patent Publication No. H3-26456, as a conventional optical fiber end-face lapping apparatus. The optical fiber end-face lapping apparatus disclosed in this publication has an eccentric board that rotates on a concentric circle of a rotation disc and a planetary gear on the eccentric board to transmit the rotation of a revolution motor so that these are combined with a lapping board to cause the lapping board to rotate and revolve.

In the conventional optical fiber end-face lapping apparatus, however, the revolution mechanism uses the planetary gear. Accordingly, even when the revolution motor is stopped, if the rotation shaft is given rotation, the planetary gear rotates while being in mesh along with a revolution motor gear being stopped. As a result, the lapping board is put in a revolutional motion. Due to this, there has been a problem that a restriction arises in setting the r.p.m. for the rotation and revolution optimally for lapping conditions.

Also, the conventional optical fiber end-face lapping apparatus is arranged to attach a fixing jig board that fixes with a plurality of ferrules having an optical fiber received inside, oppositely in parallel to the lapping board on a support table, thereby securing finished end-face accuracy of lapped objects. However, errors in attaching them inevitably occur due to the machining accuracy in the support table and the fixing jig board. As a result, there has been a defect that the plurality of the ferrules fixed in the fixing jig board, i.e. fibers, are obliquely press-contacted with the lapping board. To this end, there is a problem that a finished surface is somewhat deviated from a convex spherical surface having a center as a vertex of an ideal optical fiber.

Under such situations, the present applicant has made an application to solve the above-stated problem. This application is PCT International Publication WO94/09944, wherein the end-face lapping apparatus described in this publication has a fixing jig board for fixing a plurality of ferrules fixed with an optical fiber to support this fixing jig board by a support mechanism, and a lapping board provided with a lapping member for lapping the ferrules oppositely to the ferrules. The plurality of the ferrules are abutted at their end faces against the lapping member to have a same pressing force acting thereon at all times. The lapping board is driven by a lapping motion mechanism that is capable of performing rotation and revolution independently to thereby working the end faces of the plurality of the ferrules into a convex spherical surface.

According to the conventional lapping, however, the lap path formed on the lapping member assumes an annular configuration as shown in FIG. 7, so that the lapping member is used merely at only one part thereof in lapping. Therefore, the cost of the lapping members as expendibles occupies the greater part of the total lapping cost. That is, if lapping is performing 3–6 times, the lap sheet as a lapping member worn away, requiring periodical replacement for lapping and raising the cost. On the other hand, where the lapping member is used for a long period of time, there is a problem that the efficiency of lapping lowers the lapping quality is deteriorated.

The present invention is to solve such problems, and it is the object to provide an end-face lapping apparatus and method of lapping that is improved in the efficiency of utilizing lapping members.

SUMMARY OF THE INVENTION

A first form of the present invention for solving the above-stated problems lies, in an end-face lapping apparatus, wherein a rod member is supported on an apparatus main body by a support mechanism through a fixing jig board, a lapping board having a lapping member for lapping the rod member being rotatably swingably supported on the apparatus main body by a drive mechanism, the drive mechanism causing the lapping board to rotate about a first rotating center and at the same time swivel about about a second rotating center to thereby carry out lapping while urging the rod member fitted in the fixing jig board against the lapping member of the rotatably swinging lapping board by the support mechanism, the end-face lapping apparatus characterized to have a relative position shift means for shifting the relative position of the lapping board and the fixing jig board, and the rod member being lapped at a different portion of the lapping member each time the relative position shift means shifts the relative position of the lapping board.

Here, the lapping member is relatively large with respect to the lap path due to swiveling simultaneous with rotation of the lapping member.

Also, the fixing jig board, for example, is arranged capable of placing a plurality of rod members at positions generally equally distant from a center thereof.

A second form of the present invention lies, in an end-face lapping method, wherein a rod member is supported on an apparatus main body by a support mechanism through a fixing jig board, a lapping board having a lapping member for lapping the rod member being rotatably swingably supported on the apparatus main body by a drive mechanism, the drive mechanism causing the lapping board to rotate about a first rotating center and at the same time swivel about about a second rotating center to thereby carry out lapping while urging the rod member fitted in the fixing jig board against the lapping member of the rotatably swinging lapping board by the support mechanism, the end-face lapping method characterized in that the lapping member is provided large with respect to the lap path due to the relative motion, and lapping being made at a different portion of the lapping member by shifting the relative position relative to the fixing jig board on each lap operation.

DETAILED DESCRIPTION OF THE PREFERRED EMBODIMENT

Explanations will be made in detail hereinbelow on an embodiment of the present invention with reference to the drawings.

Figure 1:
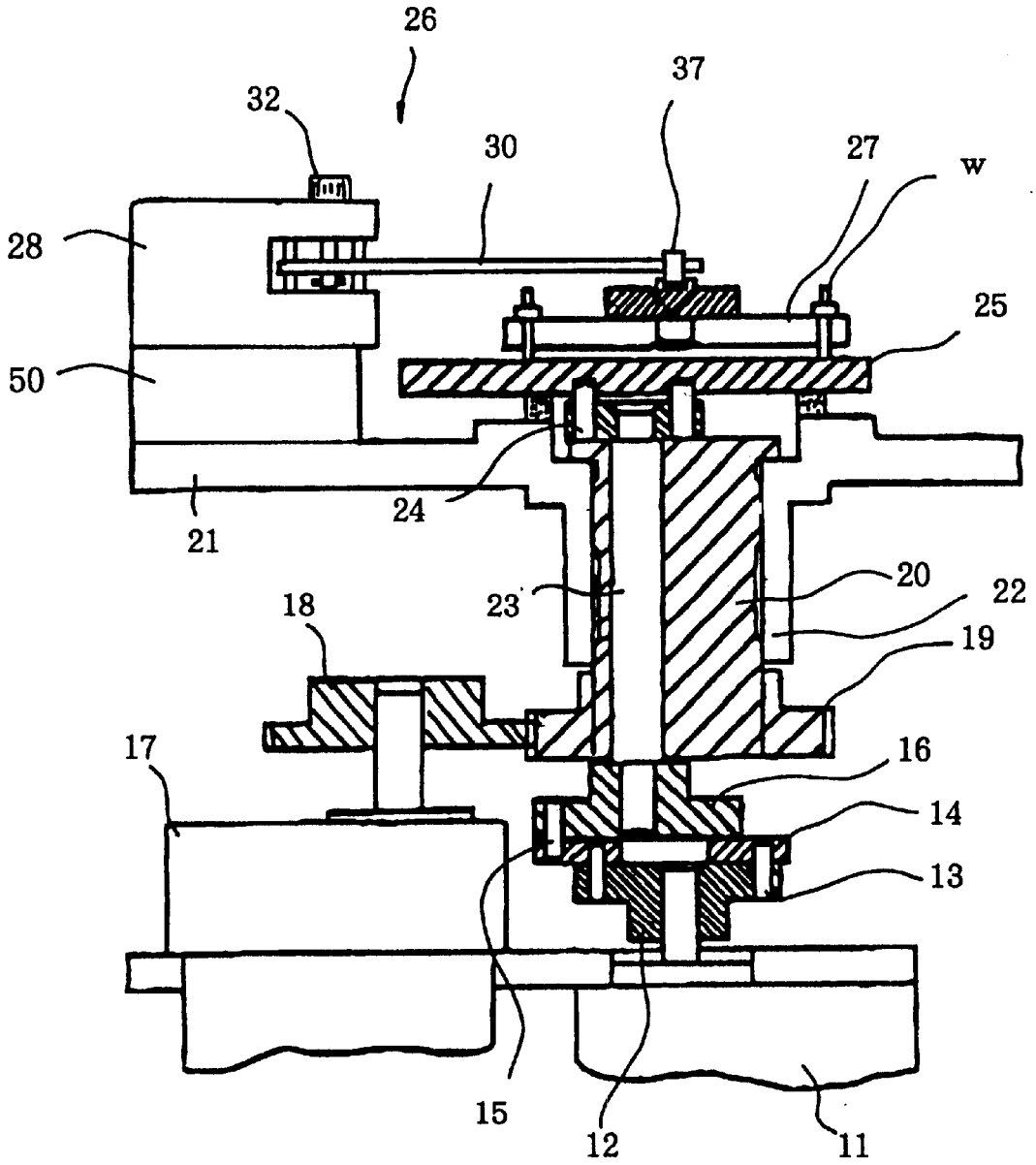
FIG. 1 is a front view of an end-face lapping apparatus in one embodiment of the present invention.
Figure 2:
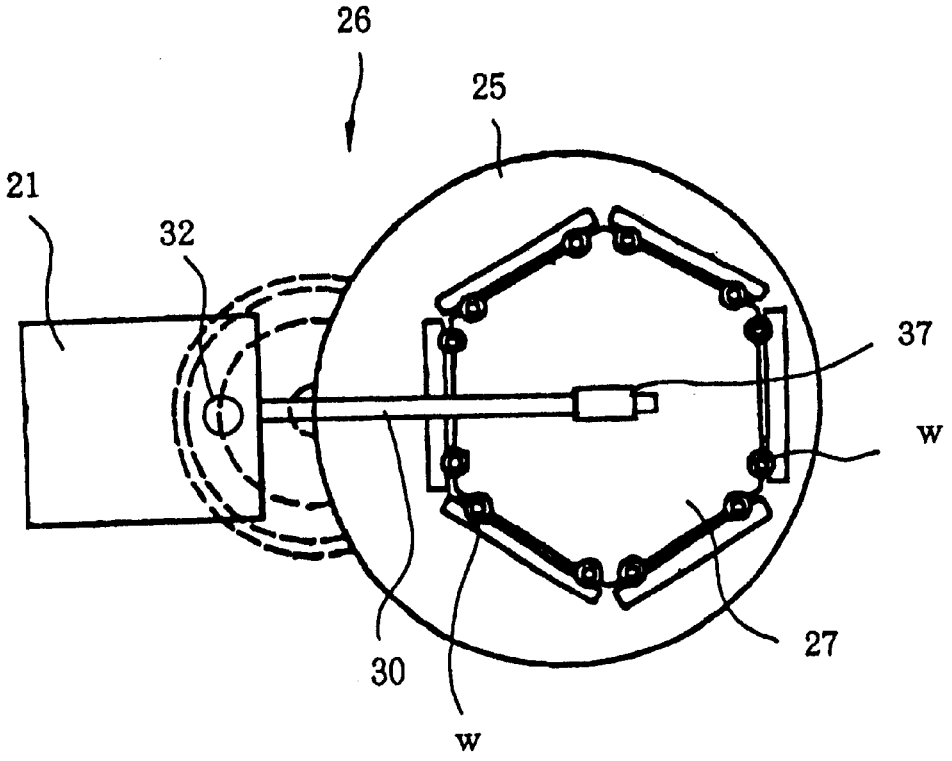
FIG. 2 is a plan view of the end-face lapping apparatus in the one embodiment of the present invention.
Figure 3:
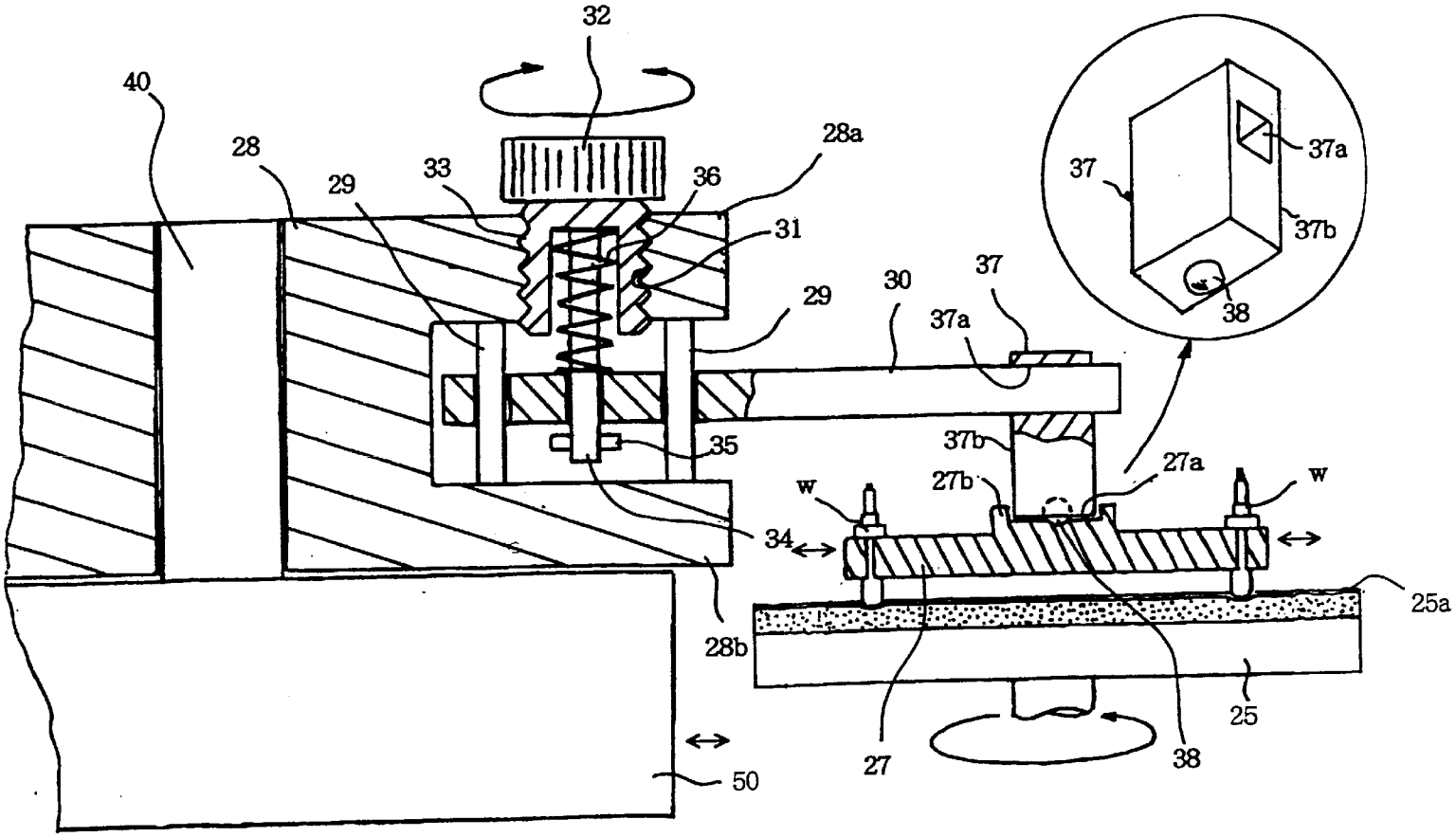
FIG. 3 is an essential part sectional view of the end-face lapping apparatus in the one embodiment of the present invention.

FIG. 1 shows a front view of an end-face lapping apparatus according to one embodiment of the present invention, FIG. 2 shows a plan view of this end-face lapping apparatus, and FIG. 3 shows an essential-part sectional view of this end-face lapping apparatus.

As shown in FIG. 1 and FIG. 2, a rotational shaft of a rotating motor 11 is firmly connected with a center portion of a first rotation transmitting board 12, and this first rotation transmitting board 12 has a plurality of first coupling pins 13 fixed on a concentric circle having a rotating center as a fulcrum. Each first connecting pin 13 is rotatably connected to an eccentric portion of each corresponding rotation transmitting board 14, and each rotation transmitting board 14 is fixed at an eccentric portion with a second connecting pin 15. Each second connecting pin 15 is rotatably connected to a second rotation transmitting board 16.

Meanwhile, a revolving motor 17 has its rotating shaft fixed with a center portion of a drive gear so that this drive gear 18 is in mesh with a driven gear 19. This driven gear 19 is fixed at a lower periphery of a revolution transmitting shaft 20, and the revolution transmitting shaft 20 is fitted at an upper periphery with a bearing sleeve 22 of an apparatus main body 21. This revolution transmitting shaft 20 rotatably receives a rotating shaft 23 for rotation at a location eccentric by a predetermined amount from its rotating center so that the rotating shaft 23 is fixed at a lower end portion with a center portion of the second rotation transmitting board 16.

Meanwhile, the rotating shaft 23 is connected at its upper end portion with a lapping board 25 through a coupling member 24. This lapping board 25 is provided at its upper surface with a lapping member, not shown. On the other hand, the apparatus main body supports, through a support mechanism, a fixing jig board 27 fixed with a plurality of rod members W such as ferrules.

That is, as shown in detail in FIG. 3, the apparatus main body 21 is provided with a slide table 50. The slide table 50 is attached with a support body 28 having upper and lower flanges 28*a*, 28*b* in a rectangular U sectional shape so that these flanges 28*a*, 28*b* have a pair of front and rear support shafts 29 attached therebetween. These support shafts 29 penetrate through a base portion of a horizontal support arm 30 so that the support arm 30 is horizontally supported for vertical movement. The flange 28*a* of the support body 28 is formed with a screw bore 31 so that this screw bore 31 is screwed with an operating screw 33 having an operating handle 32. An operating shaft 34 integral with the operating screw 33 penetrates, at a tip portion, through the support arm 30 so that it is prevented against removal-off by an engaging pin 35. A compression spring 36 is interposed between the operating screw 33 and the support arm 30.

This support arm 30 assumes rectangular in section to extend to a center portion of the lapping board 25 so as to be fitted in a coupling hole 37*a* of a holding member 37. This holding member 37 assumes rectangular in section to thereby constitute a positioning portion 37*b*, and has a ball 38 as a spherical portion at a lower surface thereof. On the other hand, the lapping board is attached, at an upper surface, with a lapping member 25*a* so that a multi-series fixing jig board 27 is located in a manner facing this lapping member 25*a*. The fixing jig board 27 has a peripheral portion at which a plurality of rod members W are detachably fixed, and an upper center portion formed with a support surface 27*a* with which the ball 38 of the holding member 37 is press-contacted and an engaging portion 27*b* with which the positioning portion 37*b* of the holding member 37 is engaged to prevent against relative rotation.

Therefore, the support arm 30 at a base portion is supported to be downwardly urged by the compression spring 36 so that the ball 38 of the holding member 37 attached at the tip portion is press-contacted with the support surface 27*a*. Through the fixing jig board 27, each rod member W is press-contacted, at its end face, with the lapping member 25*a*. Also, the fixing jig board 27 is nonrotatably supported by engaging the positioning portion 37*b* of the holding member 37 with the engaging portion 27*b* of the fixing jig board 27. The rotation of the operating handle 32 varies the urging force of the compression spring 36 interposed between the operating screw 33 and the support arm 30. The urging force of the fixing jig board 27 by the holding member 37 can be varied through the support arm 30.

The ball 38 provided as the spherical portion in this embodiment may be firmly fixed or rotatably supported. Also, although the support surface 27*a*, with which the ball 38 is press-contacted, is preferably in a curved surface so that the fixing jig board 27 is swingably supported by being press-contacted by the ball 38, it may be in a conical form. There is no especial limitation provided that it can be swingably held.

The support body 28 stated above is supported in a state of being rotatably fitted on the support column 40 provided standing on the slide table 50 so that the support body 28 as well as the support arm 30 and the fixing jig board 27, supported by the support body 28, are rotatable through 360 degrees about a center axis of the support column 40.

Figure 4A:
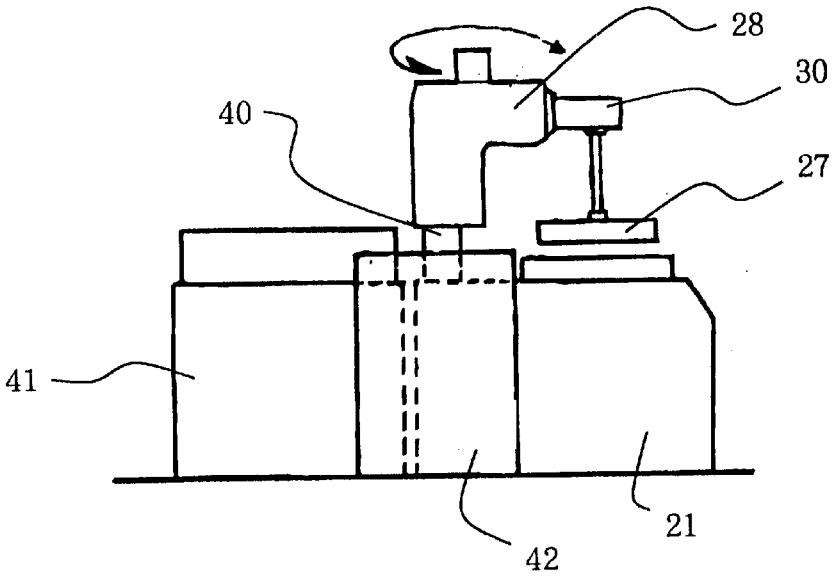
FIGS. 4*a* and 4*b* are a front view and a plan view of the end-face lapping apparatus in the one embodiment of the present invention.
Figure 4B:
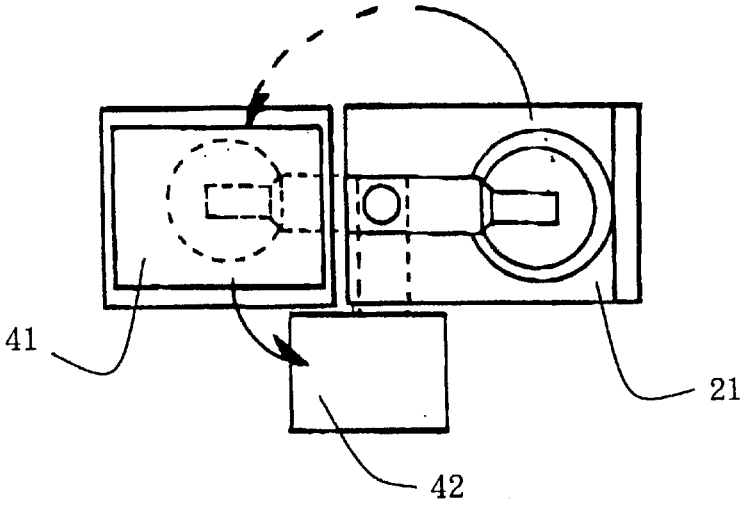

This state is shown in detail in FIGS. 4A and 4B. As shown in FIG. 4, at around the lapping apparatus are arranged, for example, a cleansing device 41 for cleansing the rod members W and fixing jig board 27 after lapping, as well as end-face inspecting device 42 for inspecting end faces of rod members being lapped, thereby making possible a plurality of operations with the ferrule remained fixed on the fixing jig. That is, after lapping the rod members W by the lapping member 25*a*, the support member 28 is rotated about the support column 40 to move the fixing jig board 27 held at the tip of the support arm 30 to the above of the cleansing device 41, thereby making possible cleansing the rod members W and the fixing jig board 27 continuously. Also, after cleaning, the further rotation of the support member 28 makes possible the moving of the fixing jig board 27 to the above of the end-face inspecting device 42, enabling inspection on the end face of each rod member W. In this manner, by providing the support member rotatable about the support column 40, a plurality of operations can be carried out with the fixing jig board 27 fixing the rod members W remained attached on the support arm 30, offering an effect of facilitating a series of operations.

Further, the slide table 50 supporting the support column 40 is movable in left-and-right horizontal directions in FIG.

3 by a slide mechanism, not shown. Also, the lapping board 25 is designed larger than an area required for lapping the rod members W supported by the fixing jig board 27. This enables the position of the fixing jig board 27 relative to the lapping board 25 to vary in a plurality of stages in the left and right directions on the lapping board 25. Further, by rotation about the above-stated support column 40 in a nearly perpendicular direction to the figure in FIG. 3, the position of the fixing jig board 27 on the lapping board 25 can be varied in a plurality of stages.

Here, explanations will be made on the operation of the end-face lapping apparatus of the above-stated present embodiment.

First as for the revolutional motion, the revolution transmitting shaft 20 is rotated by driving the revolving motor 17 through the gears 18, 19 as shown in FIG. 1 and FIG. 2, causing the lapping board 25 to perform revolving motion by a predetermined eccentric amount. In this case, although the rotating shaft 23 exists in the revolution transmitting shaft 20, a plurality of rotation transmitting boards 14 are arranged between the first rotation transmitting board 14 and the second rotation transmitting board 16. The rotation transmitting boards 14 are respectively rotated about the first pin 13 in phase with the rotation of the revolution transmitting shaft 20. Therefore, the revolution transmitting shaft 20 is not restricted from rotating, if the first rotation transmitting board 12 is in stoppage or rotation.

On the other hand, in the rotational motion the first rotation transmitting board 12 is rotated by driving the rotation motor 11. However, since the first coupling pin 13 is on the concentric circle of the rotation transmitting board 12, the passing in path is the same as the above. Although the rotational shaft 23 is eccentric by a predetermined amount, it is coupled through the rotation transmitting board 14 so that the rotation in the same rpm of the first rotation transmitting board 12 is transmitted to the rotational shaft 23.

In this manner, the lapping board 25 is revolved, while being rotated, by the rotational motion of the revolution transmitting shaft 20 and the rotational shaft 23. On the other hand, the support arm 30 is downwardly urged against the lapping member 25*a* of the lapping board 25. The positioning portion 37*b* of the holding member 37 is engaged with an engaging portion 27*b* of the fixing jig board 27 and in a state that is impossible to rotate, and the ball 38 is in press-contact with the support surface 27*a* of the fixing jig board 27 so that each rod member W is urged against the lapping member 25*a* through the fixing jig board 27.

Figure 5A:
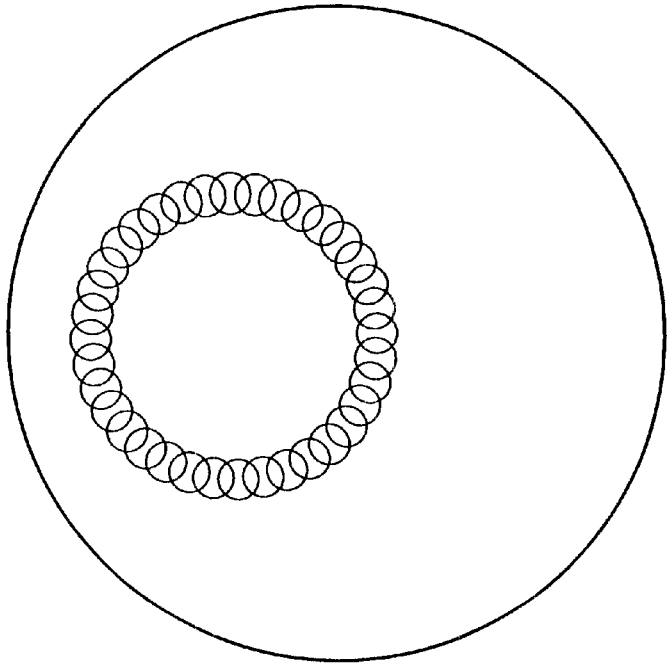
FIGS. 5*a* and 5*b* are views showing examples of lap paths in the one embodiment of the present invention.
Figure 5B:
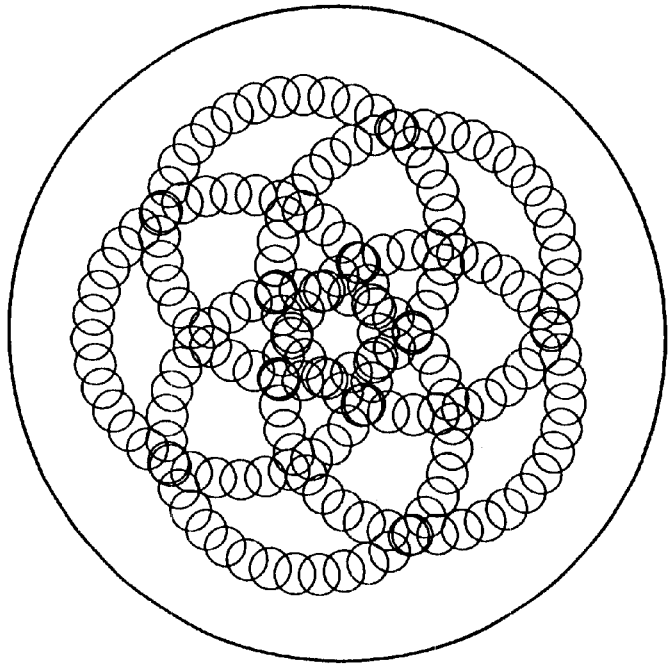

The plurality of the rod members W, by the lap operation described above, at their central positions have a lapping path, for example, as in FIG. 5A, that is annularly formed in one part of the lapping member 25*a* on the lapping board 25. Subsequently, by varying little by little the position of the fixing jig board 27 relative to the lapping board 25, a plurality of lap paths as in FIG. 5B are provided. This enables the entire surface of the lapping member 25*a* to be used averagely, and can greatly increase the life of the lapping member 25*a*. That is a, lapping operation has conventionally been made by using a lapping board and a lapping member that have a size corresponding to the lap path formed at one time, whereas in the present invention the large lap board and lapping member having a lapping surface which is large relative to the lap path are used to shift the position of the fixing jig board relative to the lapping member, forming lap paths at a plurality of positions. Therefore, it is possible to greatly improve the utilization efficiency of the lapping member.

Also, in the above embodiment, the lapping board 25 and the lapping member 25 may be circular, and the lapping board and the lapping member may be rectangular with the fixing jig board movable in both left and right directions. Also, for example, the lapping board and the lapping member may be oval or rectangular, and the fixing jig board may be movable only in one direction. Also, the drive mechanism, instead of the fixing jig board, may be provided movable.

Further, the method of the present invention is feasible by moving only the lapping member instead that the fixing jig board is moved relative to the lapping board. In this case, the lapping member can be effectively utilized by taking the size of the lapping member to a required minimum, using a large one for only the lapping member in a degree of not obstructing lap operation to somewhat shift the lapping member to perform lapping at a time point that the portion of one-time lapping path has elapsed.

Figure 7:
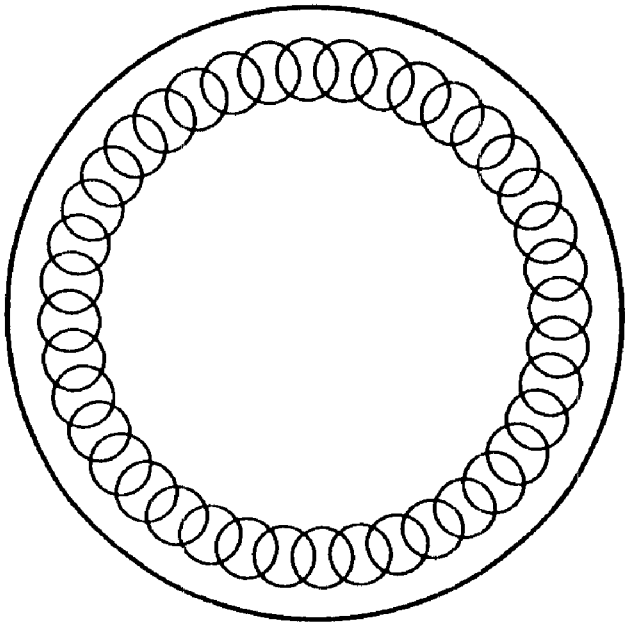
FIG. 7 PRIOR ART
FIG. 7 is a view showing one example of a lap path according to a conventional art.

For example, according to the conventional lapping method, 12 ferrules could be lapped by using a lapping member having a diameter of 110 mm (area 9503 $mm^2$) as shown in FIG. 7. Contrary to this, according to the present invention 36 ferrules could be lapped by using a lapping member (area 12473 $mm^2$) in a track oval circle having a radius at an arcuate portion of 55 mm and a lengthwise length of 137 mm to perform lap by shifting the lap position three times in the lengthwise direction. Therefore, it was confirmed in this case that the number of ferrules lapped per unit area is improved by 2.3 times.

Figure 6A:
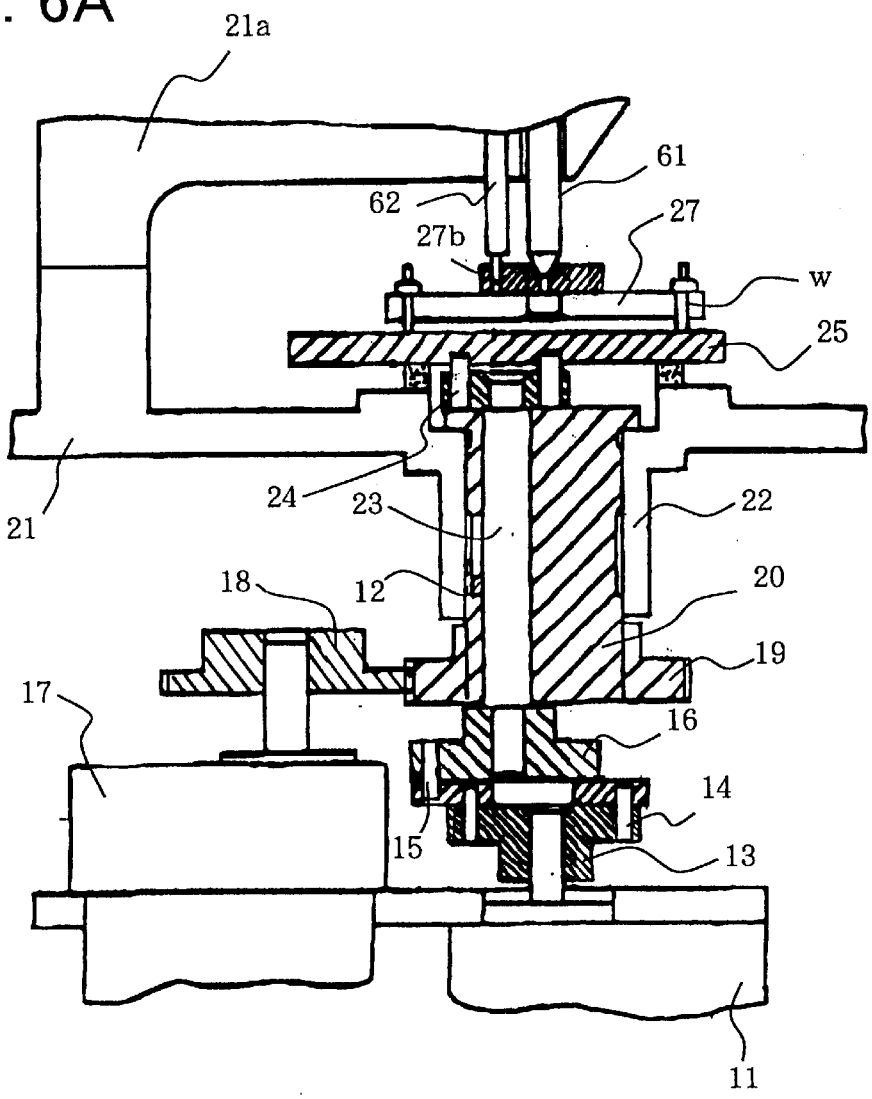
FIGS. 6*a* and 6*b* are front views of an end-face lapping apparatus in another embodiment of the present invention.
Figure 6B:
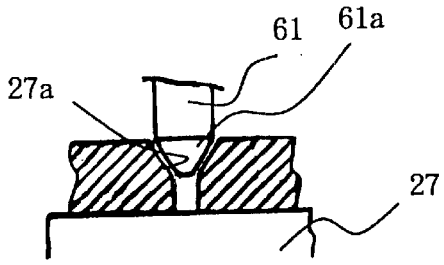

FIG. 6 shows another embodiment of the present invention. This lapping apparatus is the same in basic structure as the above-stated embodiment except that the fixing jig board 27 has a different support mechanism. The same parts are denoted by the same symbols to omit duplicated explanations.

In this example, the fixing jig board 27 is supported swingable by a pushing shaft 61 that is urged downward at a predetermined urging force against a support portion 21*a* fixed on the apparatus main body. Here, the pressing shaft 61 has, at a tip, a conical portion 61*a* which is engaged with a taper-formed fitting bore 27*a* formed at a center portion of the fixing jig board 27. The support portion 21*a* is provided with a rotation-preventive pin 62 in parallel with the pressing shaft 61. The fixing jig board 27 is restricted from rotating by inserting the tip of the rotation-preventive pin 62 in an engaging bore 27*b* of the fixing jig board 27.

In also the lapping apparatus like this, the support portion 21*a* is provided movable in the front, rear, left and right directions relative to the apparatus main body 21. Therefore, lap operations are possible while periodically shifting the fixing jig board, greatly improving the utilization efficiency for the lapping member.

Although the embodiments of the end-face lapping apparatus of the present invention were shown above, the invention is not limited to this. It is needless to say that there is no limitation provided that the apparatus is to lap end faces of rod members while performing rotation and revolution. Also, the movement of the fixing jig board relative to the lapping member may be by manual or mechanical driving.

According to the end-face lapping apparatus as explained in detail in the embodiments hereinabove, a rod member is supported on an apparatus main body by a support mechanism through a fixing jig board, and a lapping board having a lapping member for lapping the rod member being rotatably swingably supported on the apparatus main body by a drive mechanism. The fixing jig board and the lapping member are deviated in their relative positions when the rod member attached to the fixing jig board is lapped at an end face by being urged against the lapping member of the rotationally swinging lapping board by the support mechanism. Accordingly, the efficiency of utilizing lapping members is greatly improved to largely reduce the lapping cost.

What is claimed is:

1. An end-face lapping apparatus comprising:

a main body having a support mechanism for supporting a fixing jig board having at least one rod member; a lapping board supported on the main body for undergoing rotational and swivel movement and having a lapping member for lapping the rod member; a drive mechanism for rotating the lapping board and the lapping member about a first rotating center while simultaneously swiveling the lapping board about a second rotating center to thereby carry out lapping of the rod member while the rod member is urged against the lapping member by the support mechanism; and relative position shift means for shifting a relative position between the lapping board and the fixing jig board so that the rod member is lapped by a different portion of the lapping member each time the relative position between the lapping board and the fixing jig board is shifted by the relative position shift means.

2. An end-face lapping apparatus according to claim 1; wherein the lapping member has a lapping surface which is larger than a lap path of the rod member during simultaneous rotation and swivel movement of the lapping member.

3. An end-face lapping apparatus according to claim 1; wherein the at least one rod member comprises a plurality of rod members disposed at positions generally equidistant from a center of the fixing jig board.

4. An end-face lapping method comprising the steps of: providing an apparatus comprised of a main body having a support mechanism supporting a fixing jig board having at least one rod member, and a lapping board having a lapping member and supported on the main body by a drive mechanism for undergoing rotational and swivel movement during a lapping operation of the rod member, the lapping member having a lapping surface which is larger than a lap path of the rod member during the lapping operation; lapping the rod member by simultaneously rotating the lapping board about a first rotating center and swiveling the lapping board about a second rotating center while urging the rod member against the lapping surface of the lapping member and while shifting a relative position between the fixing jig board and the lapping member along the lapping surface of the lapping member so that the rod member is lapped by different portions of the lapping member.

5. An end-face lapping apparatus comprising:

a main body having a support mechanism for supporting a fixing jig board having at least one rod member; a lapping board supported on the main body for undergoing rotational and swivel movement and having a lapping member for lapping the rod member while the rod member is urged against the lapping member by the support mechanism; a drive mechanism for rotating the lapping board and the lapping member about a first rotating center while simultaneously swiveling the lapping board about a second rotating center to thereby carry out lapping of the rod member while the rod member is urged against the lapping member by the support mechanism; and relative position shift means for shifting the position of the fixing jig board to relative the lapping board so that the rod member is lapped by a different portion of the lapping member each time the position of the fixing jig board is shifted by the relative position shift means.

* * * * *